US008736412B2

(12) United States Patent
Nishino et al.

(10) Patent No.: US 8,736,412 B2
(45) Date of Patent: May 27, 2014

(54) MAGNETIC ELEMENT

(75) Inventors: Tatsumi Nishino, Tokyo (JP); Masahiko Ono, Tokyo (JP)

(73) Assignee: Sumida Corporation (JP)

( * ) Notice: Subject to any disclaimer, the term of this patent is extended or adjusted under 35 U.S.C. 154(b) by 47 days.

(21) Appl. No.: 13/292,655

(22) Filed: Nov. 9, 2011

(65) Prior Publication Data

US 2012/0119859 A1 May 17, 2012

(30) Foreign Application Priority Data

Nov. 17, 2010 (JP) ..... 2010-257248

(51) Int. Cl.

| | |
|---|---|
| ***H01F 27/02*** | (2006.01) |
| ***H01F 27/06*** | (2006.01) |
| ***H01F 27/29*** | (2006.01) |
| ***H01F 27/24*** | (2006.01) |
| ***H01F 17/04*** | (2006.01) |

(52) U.S. Cl.

USPC ..... 336/83; 336/65; 336/90; 336/192; 336/212; 336/221

(58) Field of Classification Search

USPC ..... 336/212, 83, 65, 90, 192, 221

See application file for complete search history.

(56) References Cited

U.S. PATENT DOCUMENTS

| | | | | |
|---|---|---|---|---|
| 4,888,571 | A | 12/1989 | Kobayashi et al. | |
| 5,913,551 | A | 6/1999 | Tsutsumi et al. | |
| 6,151,770 | A * | 11/2000 | Hashimoto et al. | 29/605 |
| 7,443,277 | B2 * | 10/2008 | Yamaguchi | 336/208 |
| 7,940,153 | B2 * | 5/2011 | Watanabe | 336/192 |
| 2003/0179062 | A1 * | 9/2003 | Kuwata et al. | 336/83 |
| 2005/0104702 | A1 * | 5/2005 | Sano | 336/83 |
| 2006/0022788 | A1 * | 2/2006 | Sasamori et al. | 336/208 |
| 2006/0284716 | A1 | 12/2006 | Yamaguchi | |

(Continued)

FOREIGN PATENT DOCUMENTS

| | | |
|---|---|---|
| JP | 64-39612 U | 3/1989 |
| JP | 1-163306 U | 11/1989 |

(Continued)

OTHER PUBLICATIONS

Extended European Search Report for Application No./Patent No. 11008981.0-2208, dated Mar. 6, 2012.

(Continued)

*Primary Examiner* — Elvin G Enad
*Assistant Examiner* — Ronald Hinson
(74) *Attorney, Agent, or Firm* — Cantor Colburn LLP

(57) ABSTRACT

A magnetic element may include a first core member, a second core member facing the first core member along an entire outer periphery thereof, a coil, and a base shaped body on which the first core member and the second core member are placed. The base shaped body is provided with a base member and a terminal member, and the terminal member is provided with a binding terminal part, which projects outward in a first corner part of the base member and projects from the base member on a side lower than a portion of a winding frame part side of one flange part. The second core member is provided with a cutout part at a portion corresponding to the first corner part of the base member for allowing insertion of an end drawn out from the winding frame part in a state of not contacting the second core member.

3 Claims, 14 Drawing Sheets

(56) References Cited

U.S. PATENT DOCUMENTS

| | | | | |
|---|---|---|---|---|
| 2008/0309442 | A1 | 12/2008 | Hebert | |
| 2011/0006867 | A1* | 1/2011 | Oki et al. | 336/192 |
| 2011/0291783 | A1 | 12/2011 | Yamada et al. | |

FOREIGN PATENT DOCUMENTS

| | | | |
|---|---|---|---|
| JP | 5-87911 | U | 11/1993 |
| JP | 5-90921 | U | 12/1993 |
| JP | 8-88129 | A | 4/1996 |
| JP | 10-106857 | A | 4/1998 |
| JP | 2000-36417 | A | 2/2000 |
| JP | 2001-44043 | A | 2/2001 |
| JP | 2003-168608 | A | 6/2003 |
| JP | 2007-214528 | A | 8/2007 |
| JP | 2008-108944 | A | 5/2008 |
| JP | 2009-177148 | A | 8/2009 |
| JP | 2010-182733 | A | 8/2010 |
| KR | 20100112872 | A | 10/2010 |

OTHER PUBLICATIONS

Office Action for the Japanese Patent application No. 2010-257248, mailed on Dec. 17, 2013. English translation attached.

* cited by examiner

MAGNETIC ELEMENT

BACKGROUND OF THE INVENTION

1. Field of the Invention

The present invention relates to a magnetic element.

2. Description of the Related Art

Among magnetic elements, there exists a type having a drum core, a spacer, and a ring core as described in Patent Document 1. In such a structure disclosed in Patent Document 1, a terminal is disposed on an outer peripheral side of the ring core, and an end of a lead wire is soldered to this terminal.

[Patent Document 1] Japanese Patent Application Laid-open No. 2008-108944

The magnetic element disclosed in Patent Document 1 has a structure in which the end of the lead wire contacts an edge existing in a surrounding area of a drawing portion of a large flange part, and moreover, the end of the lead wire contacts edges of the spacer and the ring core. However, when the end of the lead wire contacts edges of such a core and a spacer, the lead wire may break especially when the magnetic element is used in an environment where vibrations are given.

In particular, when the number of windings is large in order to increase the inductance value of the magnetic element, a thin wire having a small diameter of a lead wire is inevitably used, and such a thin wire is further liable to break when vibrations are given.

The present invention is made in view of such problems, and an object thereof is to provide a magnetic element capable of preventing breakage of a lead wire even in an environment where vibrations are given.

SUMMARY OF THE INVENTION

To solve the above-described problem, in one aspect of the present invention, a magnetic element includes a first core member having a pair of flange parts constituted of one flange part and another flange part, a columnar part coupling the pair of flange parts, and a winding frame part surrounded by the pair of flange parts and the columnar part, a second core member disposed to face the first core member along an entire outer periphery thereof, a coil disposed on the winding frame part by winding a lead wire, and a base shaped body on which the one flange part of the first core member is placed and on which the second core member is placed on an outer peripheral side with respect to the first core member, in which the base to shaped body is provided with a base member and a terminal member partially embedded in the base member, the terminal member is provided with a binding terminal part, which projects outward in a first corner part out of plural corner parts of the base member and projects from the base member on a side separated along an axial direction of the columnar part from a portion of the winding frame part side of the one flange part, and to which an end of the lead wire is bound, and the second core member is provided with a cutout part at a portion corresponding to the first corner part of the base member for allowing insertion of an end of the lead wire drawn out from the winding frame part in a state of not contacting the second core member.

In such a structure, by the cutout part provided in the second core member, an end of the lead wire forming the coil is guided to the binding terminal part via this cutout part. Then, the existence of this cutout part enables to create a state that the end of the lead wire does not contact the second core member. In this structure, it is possible to prevent a contact between the second core member and the end. Thus, when the magnetic element is used in an environment where vibrations are given, breakage of the lead wire at a contact portion of the second core member and the end can be prevented. Since breakage of the lead wire can be prevented effectively in an environment where vibrations are given, the number of windings of the coil can be increased using a thin wire having a smaller diameter as the lead wire, and it is possible to increase the inductance value of the magnetic element.

Further, in another aspect of the magnetic element of the present invention, in addition to the above-described invention, preferably, the base member is provided with a guide portion guiding an end of the lead wire toward the binding terminal part on an outer peripheral side from the winding frame part on an inner peripheral side and having a taper shape descending from the inner peripheral side toward the outer peripheral side, and an inner peripheral end portion on the inner peripheral side of the guide portion is located on the other flange part side along the axial direction with respect to a portion on the winding frame part side of the one flange part.

In such a structure, the end of the lead wire forming the coil is guided to the binding terminal part while the end is prevented from contacting the outer peripheral edge of the one flange part of the first core member. Accordingly, it is possible to further decrease the contact position of the end, and the lead wire can be prevented from breaking at the contact portion of the aforementioned outer peripheral edge and the end even when the magnetic element is used in an environment where vibrations are given. Since breakage of the lead wire can thereby be prevented more effectively in an environment where vibrations are given, the number of windings of the coil can be increased using a thin wire having a smaller diameter as the lead wire, and it is possible to increase the inductance value of the magnetic element.

Moreover, in another aspect of the magnetic element of the present invention, in addition to the above-described invention, preferably, the terminal member is provided with a vertical extending portion and a horizontal extending portion continuing to the vertical extending portion, the vertical extending portion extends along outer wall faces of a second corner part out of the plural corner parts of the base member and the second core member toward the other flange part, and the horizontal extending portion is bent from the vertical extending portion, and by this bending, the horizontal extending portion is disposed to face a face of the other flange part opposite to the winding frame part and a portion of the second core member opposite to the side placed on the base member, so as to suppress movement of the first core member and the second core member toward the axial direction.

In such a structure, a forming terminal part is provided, this forming terminal part is provided with a horizontal extending portion, and this horizontal extending portion is disposed to face the first core member and the second core member. Thus, it is possible to effectively suppress movement of the first core member and the second core member toward the axial direction. Accordingly, breakage of the lead wire can be prevented more effectively in an environment where vibrations are given, the number of windings of the coil can be increased using a thin wire having a smaller diameter as the lead wire, and it is possible to increase the inductance value of the magnetic element.

According to the present invention, it is possible to prevent breakage of a lead wire even in an environment where vibrations are given.

DETAILED DESCRIPTION OF THE PREFERRED EMBODIMENT

Hereinafter, a magnetic element 10 according to one embodiment of the present invention will be described based on FIG. 1 to FIG. 14.

Figure 6:
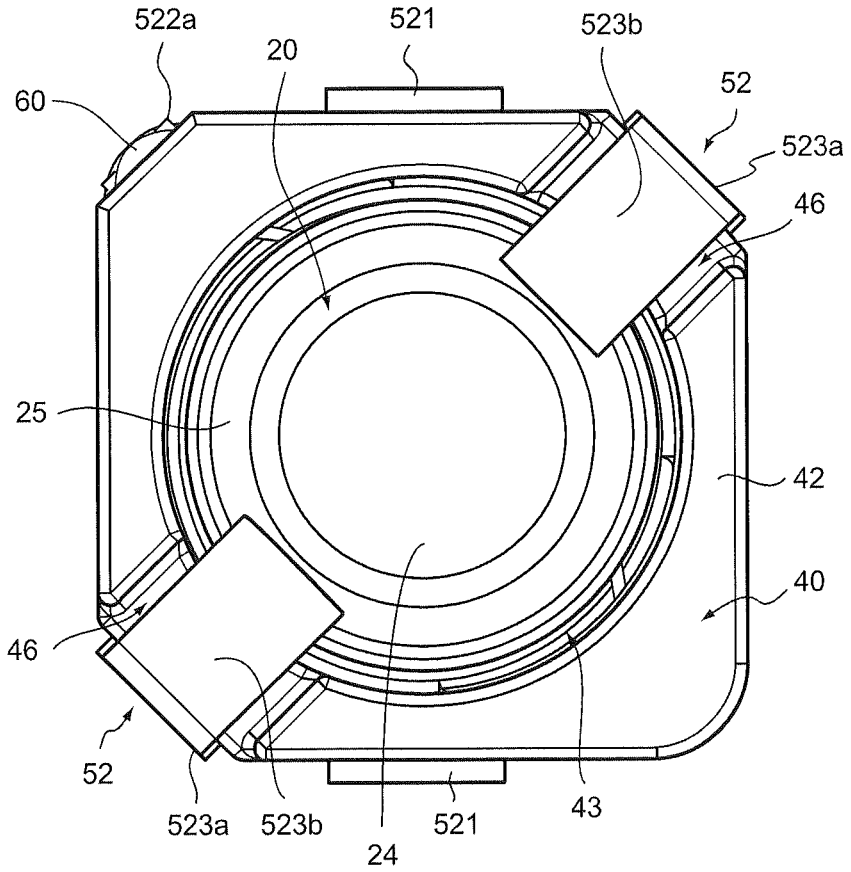
FIG. 6 is a plan view of the magnetic element of FIG. 1.
Figure 7:
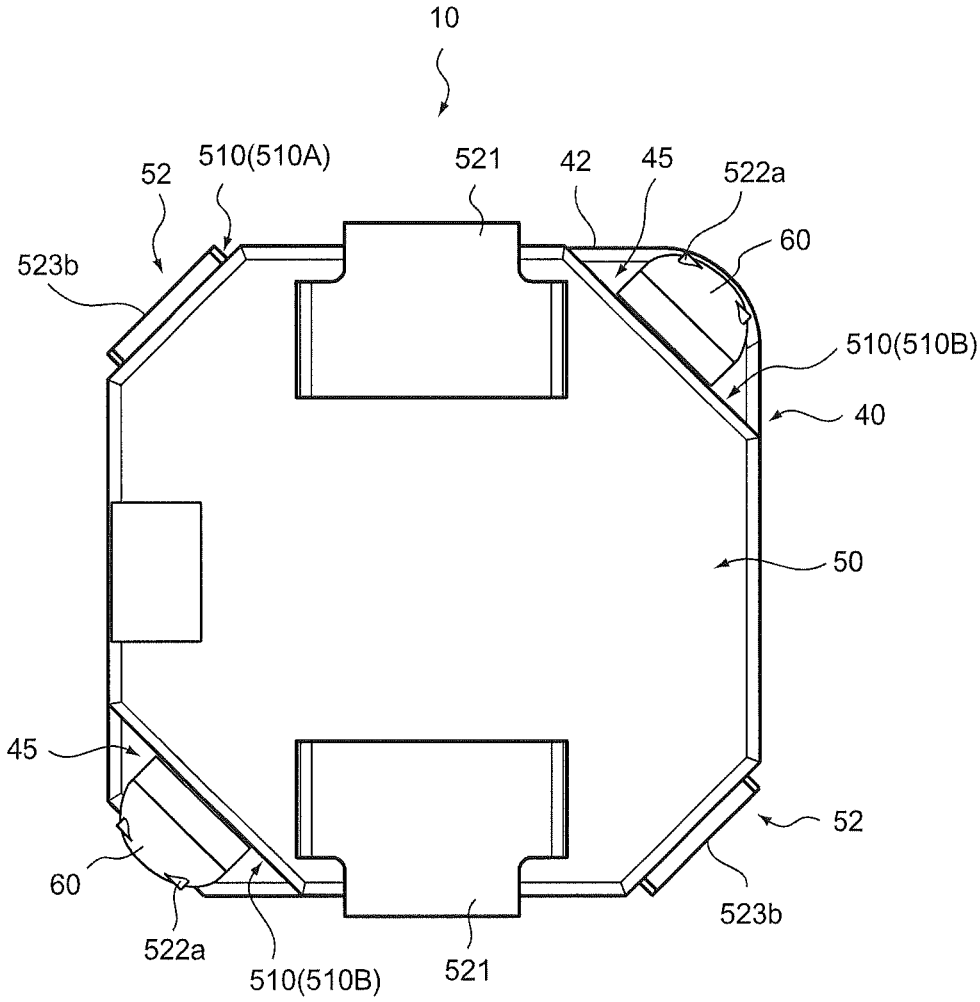
FIG. 7 is a bottom view of the magnetic element of FIG. 1.
Figure 8:
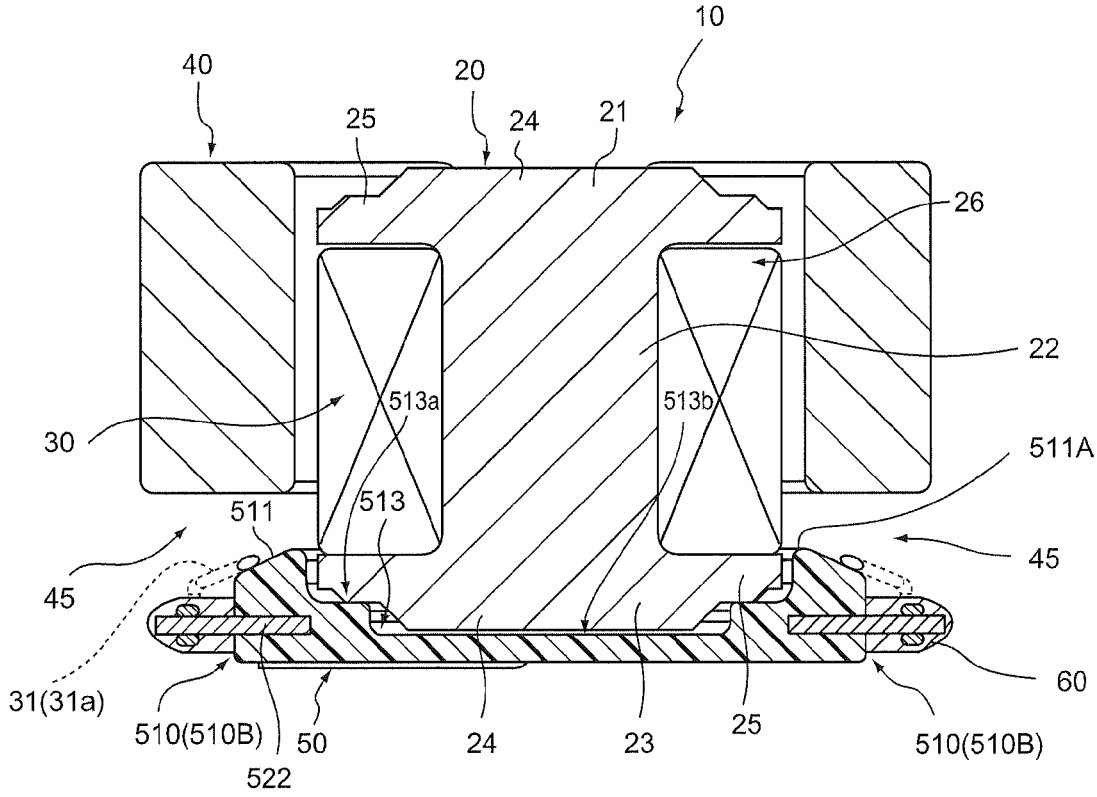
FIG. 8 is a cross-sectional side view of the magnetic element of FIG. 1 and illustrates a state that a binding terminal part is cut.
Figure 9:
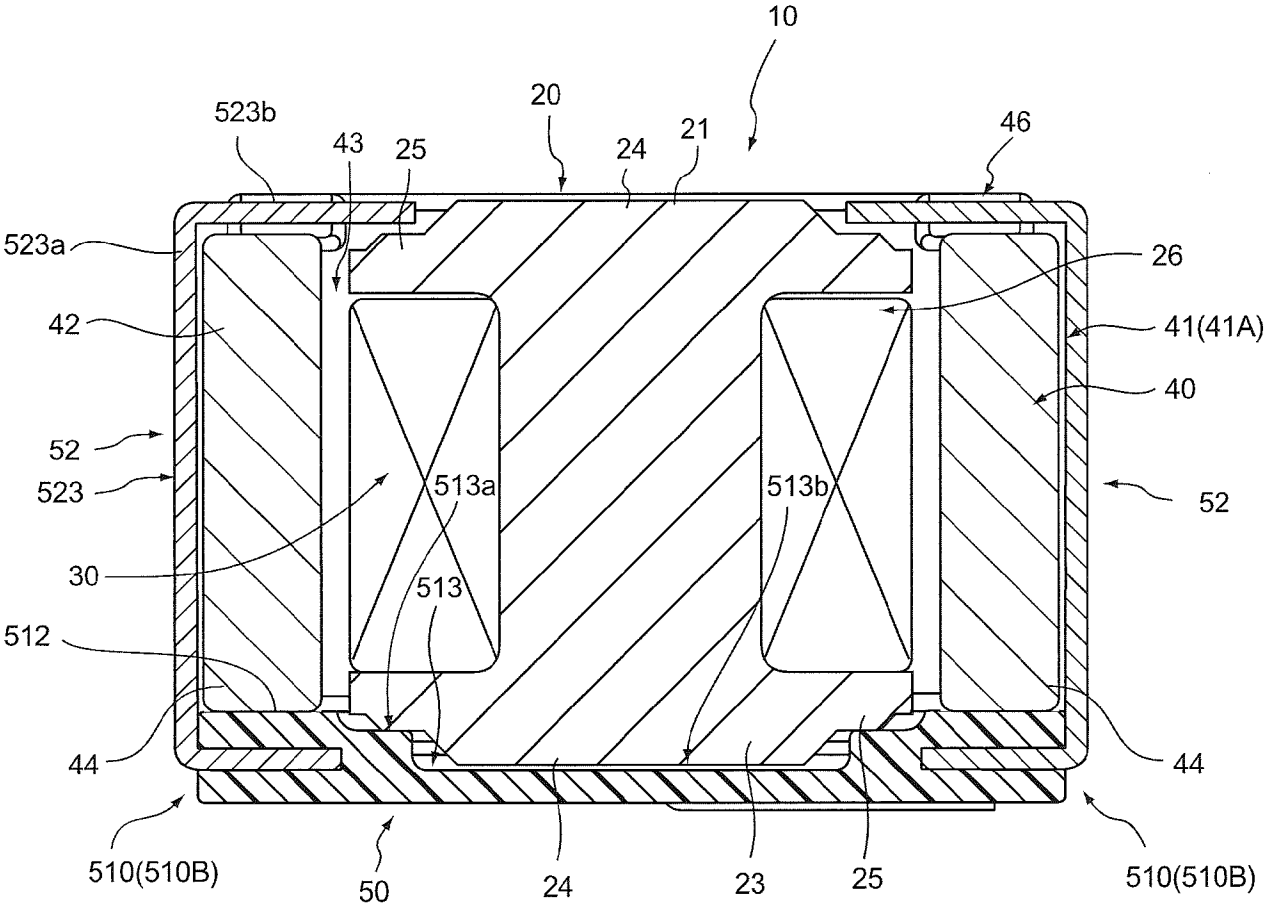
FIG. 9 is a cross-sectional side view of the magnetic element of FIG. 1 and illustrates a state that a forming terminal part is cut.

As illustrated in FIG. 1 to FIG. 9 and the like, the magnetic element 10 of this embodiment includes a drum core 20, a coil 30, a ring core 40, and a base shaped body 50. Among them, the drum core 20 corresponds to a first core member. This drum core 20 has, as illustrated in FIG. 6, FIG. 8 and FIG. 9 and the like, an upper flange part 21, a columnar part 22, and a lower flange part 23. The upper flange part 21, the columnar part 22, and the lower flange part 23 are provided to have a circular planar shape. In this embodiment, the upper flange part 21 of the drum core 20 is provided to be equal in diameter to the lower flange part 23. Further, in this embodiment, the upper flange part 21 and the lower flange part 23 are provided to have a same thickness dimension of a flange part.

Note that the lower flange part 23 corresponds to one flange part, and the upper flange part 21 corresponds to another flange part.

Here, the upper flange part 21 and the lower flange part 23 are provided with a center projecting portion 24. The center projecting portion 24 is a portion where a center side portion in a radial direction thereof projects in a direction to be separated from the columnar part 22 more than an outer peripheral side portion in the radial direction. The center projecting portion 24 is a portion entering a recessed portion 513 of the base shaped body 50. By the center projecting portion 24 entering the recessed portion 513, rough positioning of the drum core 20 with respect to the base shaped body 50 is performed. Note that in the following description, in the upper flange part 21 and the lower flange part 23, a portion on an outer peripheral side with respect to the center projecting portion 24 will be referred to as an outer peripheral portion 25.

Further, in the drum core 20, a part surrounded by the upper flange part 21, the columnar part 22, and the lower flange part 23 is a winding frame part 26, on which it is possible to wind a lead wire 31 to form a coil 30.

Figure 10:
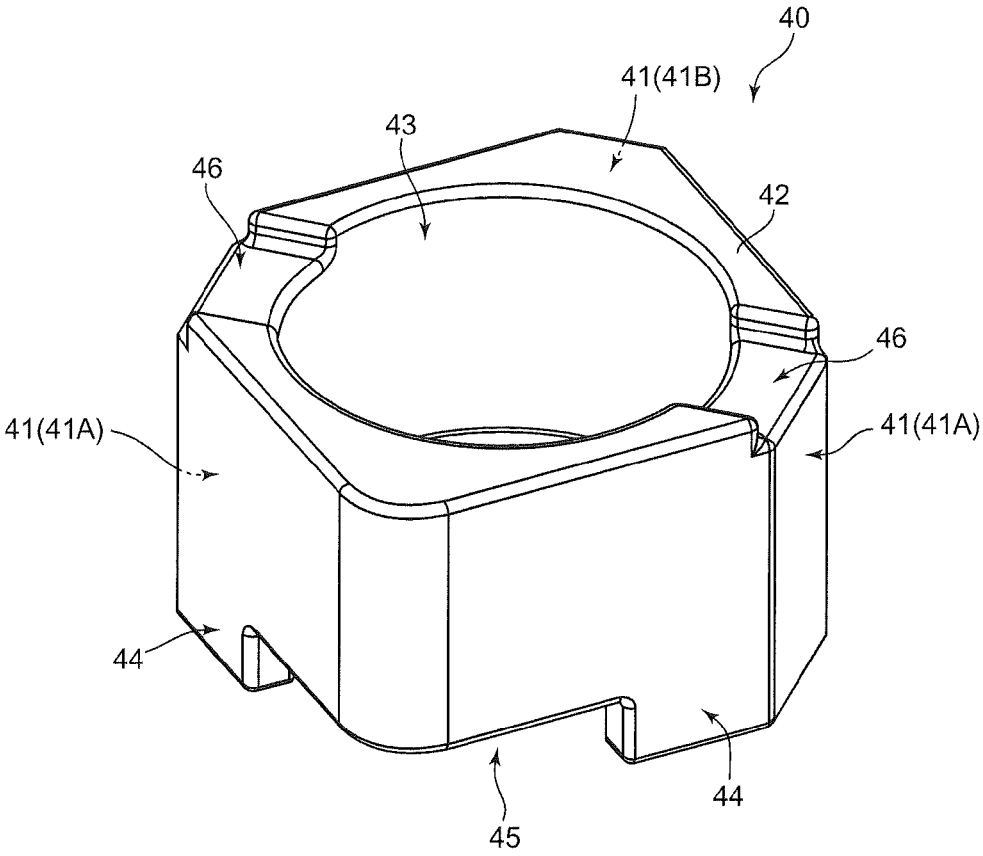
FIG. 10 is a perspective view illustrating a shape of a ring core of the magnetic element of FIG. 1.

Further, the ring core 40 corresponds to a second core member. This ring core 40 is, as illustrated in FIG. 10, a core member located on an outer peripheral side of the drum core 20 and the coil 30. This ring core 40 is provided in a substantially rectangular annular shape when it is seen from above. However, at least two of four corners of the rectangular shape of the ring core 40 (three in FIG. 10) have a shape which is cut off so as to form a substantially 45-degree angle with respect to wall faces forming these four corners. In the following description, these parts cut off will be referred to as a cut off part 41. Further, in the following description, among the cut off parts 41, one in which a forming terminal part 523 is located, which will be described later, will be referred to as a cut off part 41A, and other cut off parts 41 will be referred to as a cut off part 41B as necessary. Further, in the ring core 40, an annular substantial part of hardened magnetic powder will be referred to as a core part 42, and a hole part surrounded by the core part 42 will be referred to as a ring hole 43. Note that in this embodiment, the ring hole 43 is provided to have a substantially circular shape. Moreover, the substantially circular shape includes a circular shape. Further, any other shape to which "substantially" is added likewise includes a shape from which "substantially" is removed.

The drum core 20 and the coil 30 are located in the ring hole 43 of the ring core 40. Further, the base shaped body 50 is located below the ring core 40 and the drum core 20. Here, on a lower end side of the ring core 40, there is provided a lower extending portion 44 which contacts a placing portion 512 on an outer peripheral side of the base shaped body 50. That is, the ring core 40 is in a state of being placed on the base shaped body 50 via the lower extending portion 44, and the ring core 40 is in a state of being positioned on the base shaped body 50 by the lower extending portion 44.

Further, in the ring core 40, a cutout part 45 is provided in a portion adjacent to the lower extending portion 44 in a circumferential direction of the core part 42. The cutout part 45 is a part where the core part 42 is cut out by a predetermined depth from a lower side toward an upper side of the ring core 40. The existence of this cutout part 45 creates a state that a predetermined gap exists between the core part 42 and the base shaped body 50 and an end 31*a*, in a state that the lower extending portion 44 contacts the core part 42.

Further, on an upper face side of the ring core 40, upper recessed portions 46 recessed downward are provided. Two upper recessed portions 46 are provided in this embodiment, and these two upper recessed portions 46 are disposed along a diagonal direction of the ring core 40. Further, the upper recessed portions 46 are provided to communicate with cut off parts 41A. Accordingly, a forming terminal part 523, which will be described later, is in a state of being located in a cut off part 41A and an upper recessed portion 46. Note that such an upper recessed portion 46 has a width dimension and a depth dimension which are sufficient to allow entrance of the forming terminal part 523.

Note that the drum core 20 and the ring core 40 is made of a magnetic material, and as this magnetic material, for example, it is possible to use one of various ferrites, such as a nickel-based ferrite or manganese-based ferrite, permalloy, sendust, or the like.

Further, as illustrated in FIG. 8, FIG. 9, and the like, the base shaped body 50 has a base member 51 and a terminal member 52. The base member 51 is a part formed of resin by molding with a metal mold, or the like. Further, the terminal member 52 in this embodiment is a part formed by placing a hoop terminal plate 100 (see FIG. 12), which will be described later, in a metal mold, insert molding the base shaped body 50, and thereafter cutting the hoop terminal plate 100, or the like.

Figure 1:
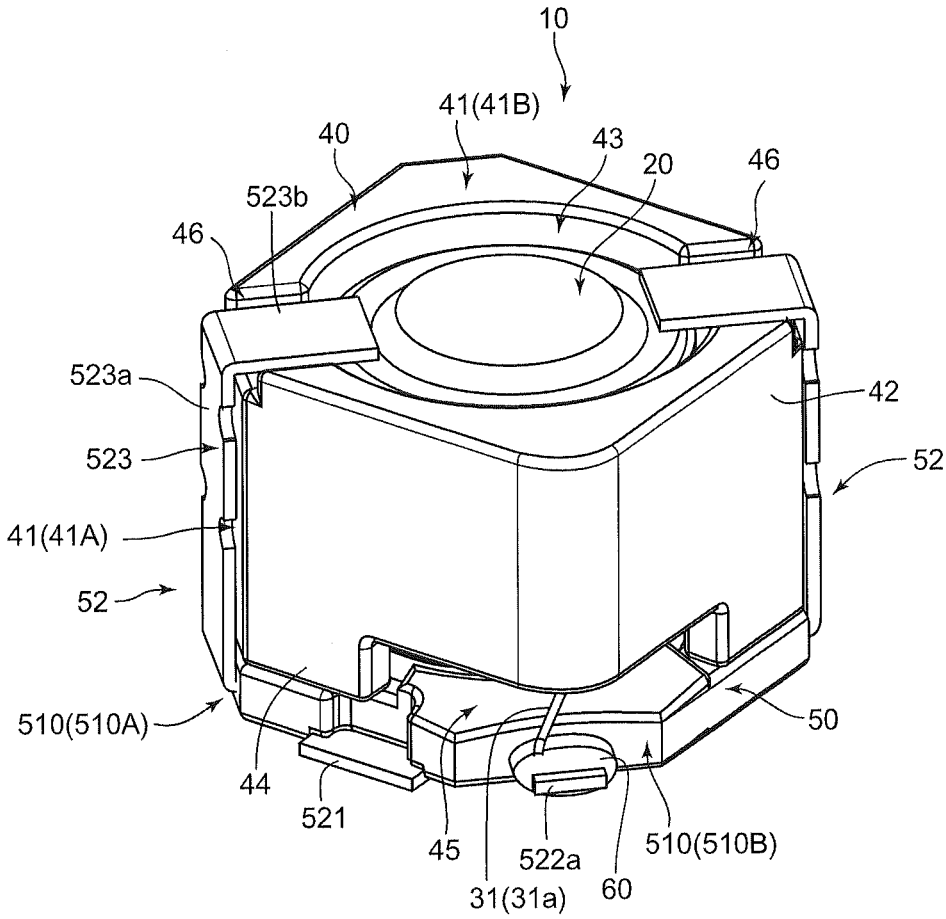
FIG. 1 is a perspective view of a magnetic element according to one embodiment of the present invention.
Figure 2:
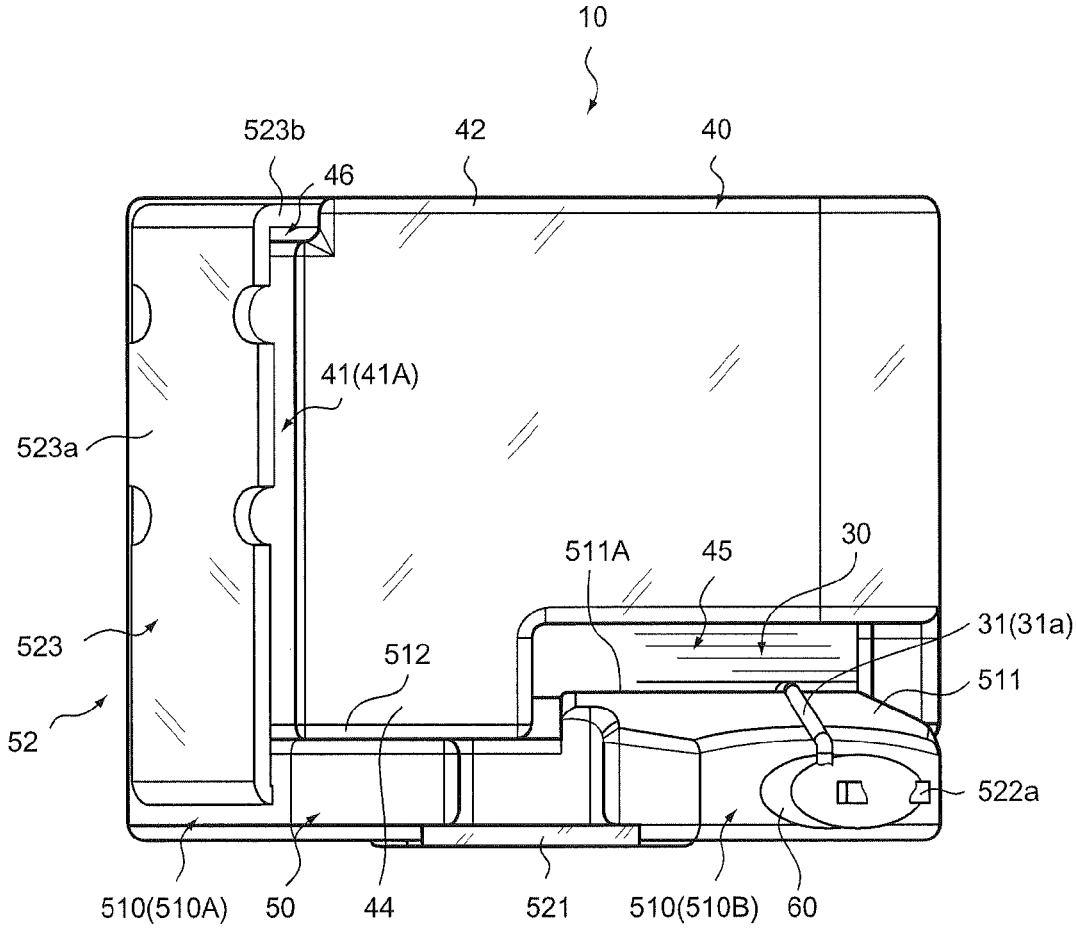
FIG. 2 is a front view of the magnetic element of FIG. 1.
Figure 3:
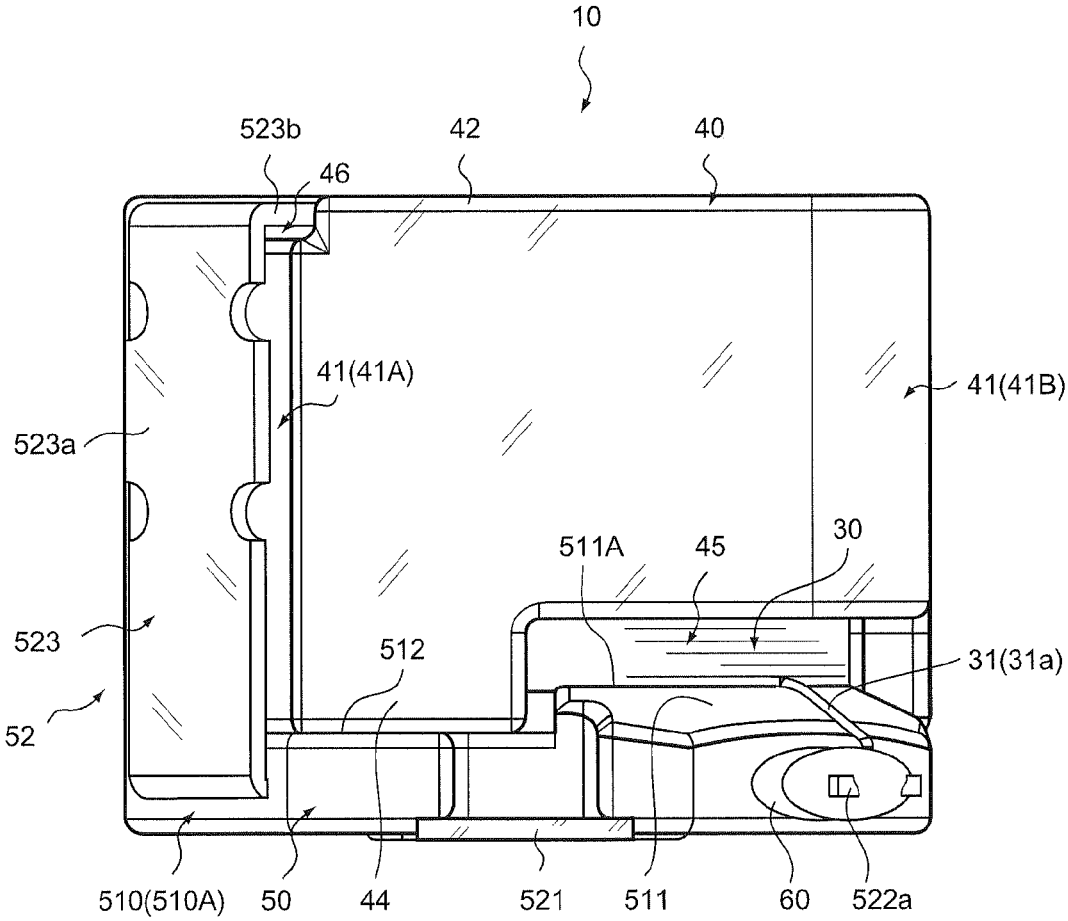
FIG. 3 is a rear view of the magnetic element of FIG. 1.
Figure 4:
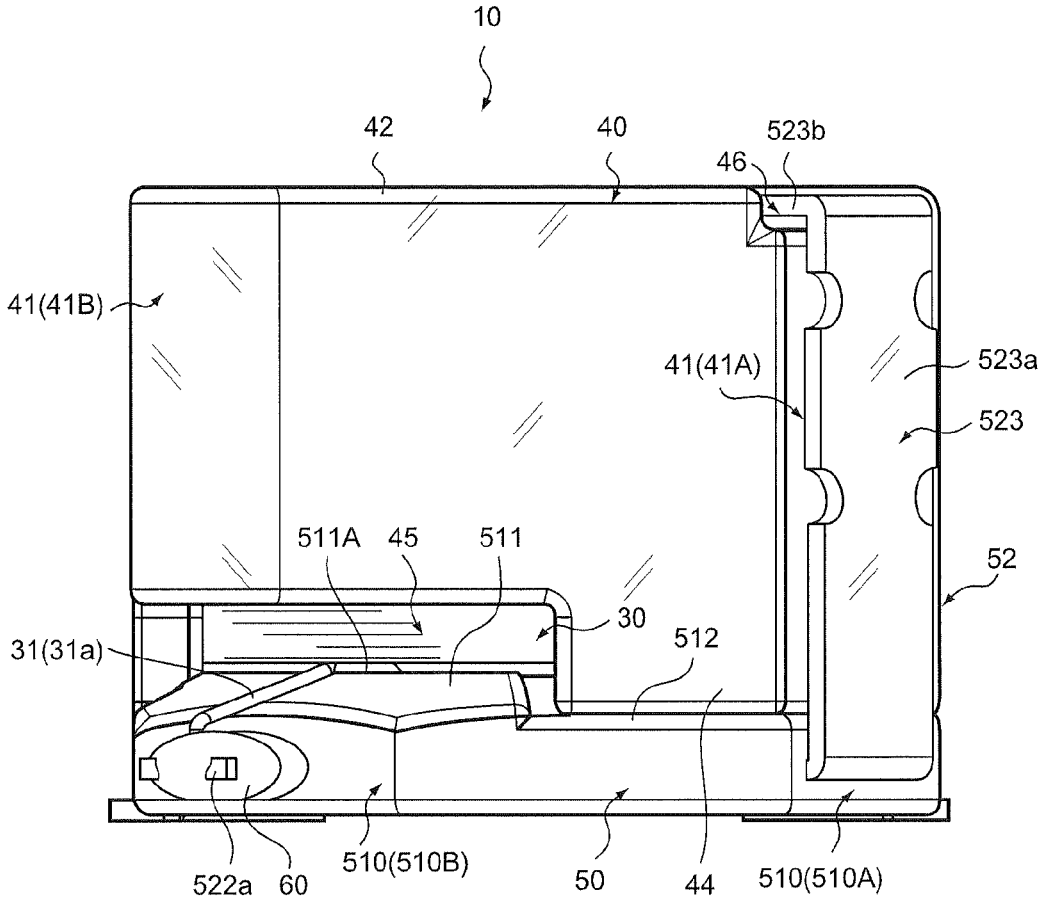
FIG. 4 is a left side view of the magnetic element of FIG. 1.
Figure 5:
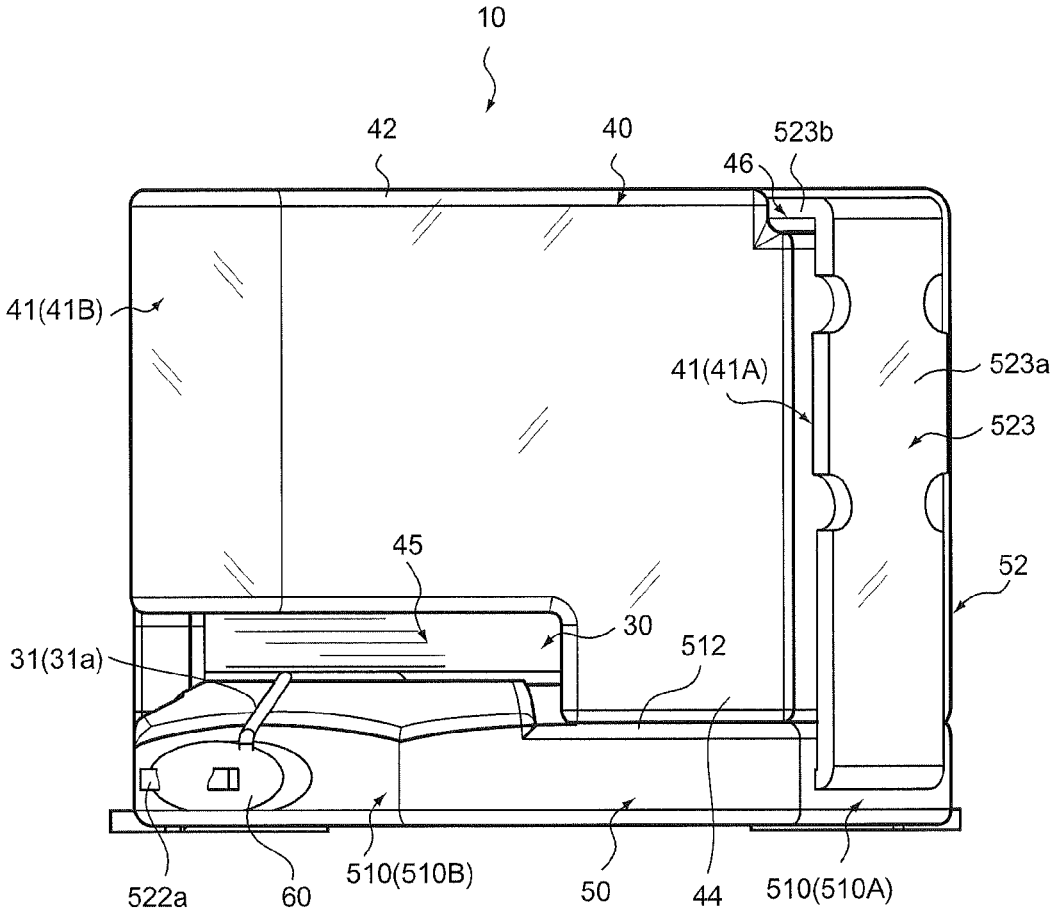
FIG. 5 is a right side view of the magnetic element of FIG. 1.

When the above-described base member 51 is seen in a plan view, its shape is substantially similar to a planar shape of the above-described ring core 40. However, as illustrated in FIG. 1, FIG. 7, and the like, either a binding terminal part 522 or a forming terminal part 523 is always located in the four corners of the base member 51. Accordingly, it is structured such that corner cut parts 510 corresponding to the cut off parts 41 of the ring core 40 always exist at four corners (corresponding to corner parts) of the base member 51. In the following description, the corner cut part 510 in which the forming terminal part 523, which will be described later, is located will be referred to as a corner cut part 510A, and the corner cut part 510 in which the binding terminal part 522, which will be described later, is located will be referred to as a corner cut part 510B. Note that the corner cut part 510A corresponds to a first corner part, and the corner cut part 510B corresponds to a second corner part.

The base member 51 has a guide portion 511, a placing portion 512, and a recessed portion 513. The guide portion 511 is a portion which guides an end 31*a* of the lead wire 31 forming the coil 30 toward the binding terminal part 522, and is provided on an outer peripheral side of the recessed portion 513. Here, the guide portion 511 is provided to have a larger height dimension than the placing portion 512. Particularly in a state that the center projecting portion 24 of the drum core 20 is located in the recessed portion 513 so as to position this drum core 20 on the base shaped body 50, a height position of an end portion 511A (see FIG. 8) of an inner diameter side of the guide portion 511 is equal to a height position of the winding frame part 26 side of the lower flange part 23 or slightly higher than the height position of the winding frame part 26 side of the lower flange part 23 (see FIG. 8). Accordingly, when the end 31*a* of the lead wire 31 forming the coil 30 is drawn out from the winding frame part 26, it is possible to prevent the end 31*a* from contacting an edge existing on an outer peripheral edge side of the lower flange part 23.

Note that in the guide portion 511, a corner in the vicinity of the end portion 511A on the inner diameter side is provided to curve in a state of preventing breakage of the end 31*a*. Further, in the guide portion 511, also an end portion of an outer diameter side is also provided to curve in a state of preventing breakage of the end 31*a*. In addition, an upper face of the guide portion 511 is provided in a taper shape descending from an inner peripheral side toward an outer peripheral side.

Further, the placing portion 512 is provided on the outer peripheral side of the recessed portion 513 similarly to the above-described guide portion 511. This placing portion 512 is provided in a portion adjacent to the to guide portion 511 in a circumferential direction of the base member 51. As described above, a lower end side of the lower extending portion 44 is placed on this placing portion 512. Accordingly, the ring core 40 is positioned by this placing portion 512. Further, the recessed portion 513 is a portion in the base member 51 which is recessed downward to be lower than the guide portion 511 and the placing portion 512. In this embodiment, the recessed portion 513 is provided with a shelf portion 513*a* and a center recessed portion 513*b*. The shelf portion 513*a* is a portion having a smaller depth dimension than the center recessed portion 513*b*. This shelf portion 513*a* is contacted by the outer peripheral portion 25 on the periphery of the center projecting portion 24 in the lower flange part 23. Accordingly, the drum core 20 is positioned in a height direction with respect to the base shaped body 50. Further, the center recessed portion 513*b* is a portion where the center projecting portion 24 enters. In this embodiment, in a state that the outer peripheral portion 25 of the lower flange part 23 contacts the shelf portion 513*a*, a predetermined gap exists between a bottom face of the center recessed portion 513*b* and a lower face of the center projecting portion 24.

Figure 11:
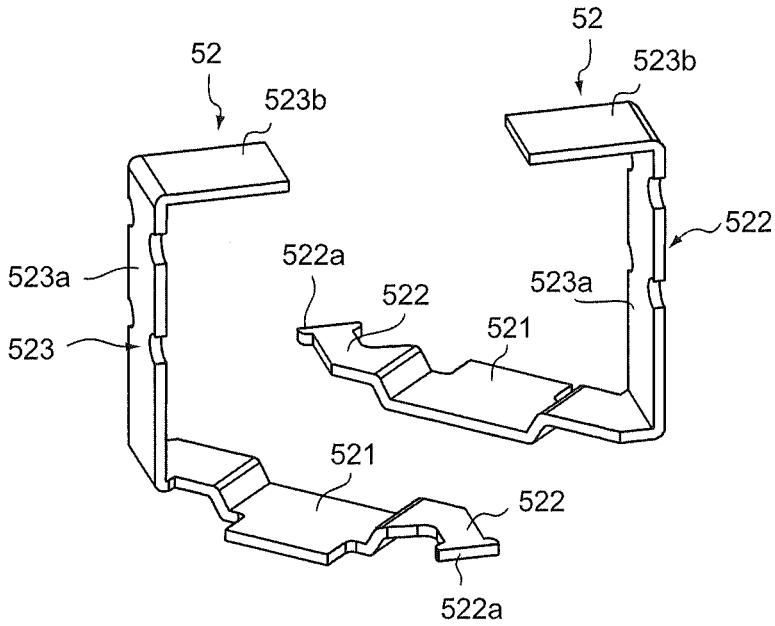
FIG. 11 is a perspective view illustrating a shape of a terminal member of the magnetic element of FIG. 1.

Further, as illustrated in FIG. 1, FIG. 8, FIG. 9, and the like, the terminal member 52 is formed to be integrated with the base member 51. This terminal member 52 is provided with, as illustrated in FIG. 11, a user terminal part 521, a binding terminal part 522, and a forming terminal part 523. Note that in this embodiment, the user terminal part 521, the binding terminal part 522, and the forming terminal part 523 are provided continuously so that condition of electricity is possible. The user terminal part 521 is a part which projects downward from a bottom face of the base member 51 and is exposed downward to the outside. That is, the user terminal part 521 is a portion located lowest in the terminal member 52. This user terminal part 521 is connected and fixed to a not-illustrated mounting substrate in a state of being electrically conductive. Further, the binding terminal part 522 is provided in the corner cut part 510B of the base member 51. This binding terminal part 522 extends toward a normal direction of an outer wall face of the corner cut part 510B, and the binding terminal part 522 is provided with a flange portion 522*a* preventing removal of the end 31*a* when the end 31*a* is wound thereon.

Further, the forming terminal part 523 is provided in the corner cut part 510A of the base member 51, and projects larger than the binding terminal part 522 from an outer wall face of the corner cut part 510A. This is forming terminal part 523 is provided with a vertical extending portion 523*a* and a horizontal extending portion 523*b*. The vertical extending portion 523*a* is a portion extending in a vertical direction along outer wall faces of the corner cut part 510A and the cut off part 41A. Further, the horizontal extending portion 523*b* is a portion extending along a horizontal direction from an upper side end portion of the vertical extending portion 523*a*. In this embodiment, this horizontal extending portion 523*b* is a portion which enters the upper recessed portion 46. Further, a front end of extension of the horizontal extending portion 523*b* is provided to reach the outer peripheral portion 25 of the upper flange part 21. That is, the vertical extending portion 523*a* contacts the corner cut part 510A of the base member 51 and the cut off part 41A, the horizontal extending portion 523*b* contacts a bottom portion of the upper recessed portion 46, and further the front end side of the horizontal extending portion 523*b* contacts the outer peripheral portion 25 of the upper flange part 21. Thus, in this state, the base shaped body 50, the ring core 40, and the drum core 20 are positioned in the vertical direction. In this manner, the forming terminal part 523 has a function of positioning the base shaped body 50, the ring core 40, and the drum core 20.

<Regarding a Method of Producing the Magnetic Element 10>

A method of producing the magnetic element 10 having the above-described structure will be described below.

Figure 12:
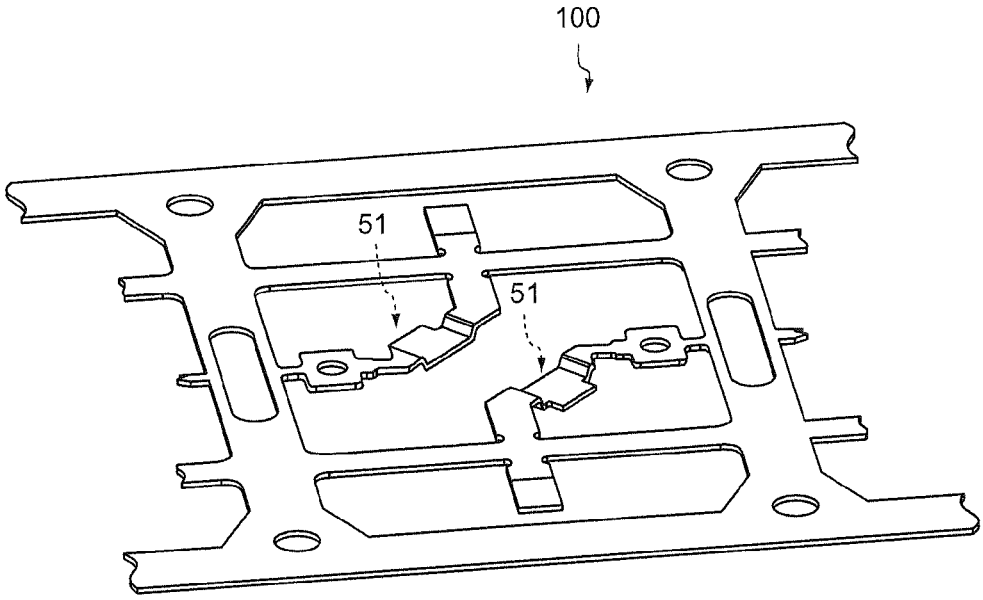
FIG. 12 is a perspective view illustrating a shape of a hoop terminal used when the magnetic element of FIG. 1 is produced.
Figure 13:
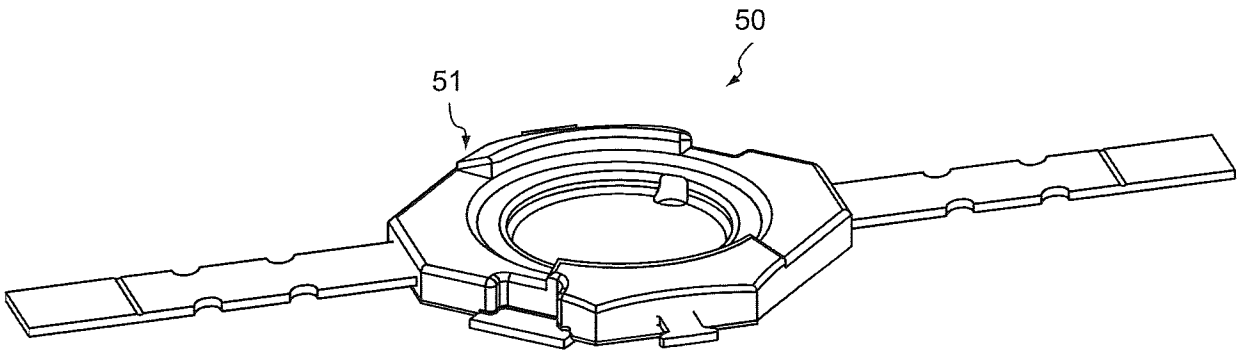
FIG. 13 is a perspective view illustrating a middle stage of production of the magnetic element of FIG. 1 and illustrating a state that after a base member is formed by insert molding, it is cut off from the hoop terminal.

First, a hoop terminal plate 100 as illustrated in FIG. 12 is formed by press forming a metal plate, or the like. In this hoop terminal plate 100, a portion corresponding to the terminal member 52 (portion corresponding to the terminal member 52 before being cut and bent) exists. Subsequently, this hoop terminal plate 100 is placed in a not-illustrated metal mold, and molten resin is poured into this metal mold, so as to insert mold the base shaped to body 50. Subsequently, the hoop terminal plate 100 is cut in a manner leaving portions needed as the binding terminal part 522 and the forming terminal part 523 (see FIG. 13). Thereafter, with a lower face side of the lower flange part 23 being applied with an adhesive, the center projecting portion 24 of the drum core 20 is inserted in the recessed portion 513 of the base member 51. Then, by the adhesive curing, the drum core 20 is adhered on the base member 51.

Next, the lead wire 31 is wound on the winding frame part 26 of the drum core 20 to form the coil 30. At this time, a winding start portion of the lead wire 31 is wound on one binding terminal part 522, and a winding end portion of the lead wire 31 is wound on another binding terminal part 522, thereby completing formation of the coil 30. Subsequently, the binding terminal parts 522 are soldered so that the ends 31*a* do not detach from the binding terminal parts 522. Accordingly, solder parts 60 illustrated in FIG. 1 and the like are formed.

Subsequently, the ring core 40 is attached. In this case, with the lower end side of the lower extending portion 44 of the ring core 40 being applied with an adhesive, the lower end side of the lower extending portion 44 is placed on the placing portion 512. Then, by the adhesive curing, the ring core 40 is adhered to the base member 51. Subsequently, the horizontal extending portion 523*b* is formed by bending the forming terminal part 523. Further, after the horizontal extending portion 523*b* is formed, the vertical extending portion 523*a* is formed by bending the forming terminal part 523.

As described above, the magnetic element 10 as illustrated in FIG. 1 and the like is formed.

<Effects>

In the magnetic element 10 having the above-described structure, the cutout part 45 provided in the ring core 40 allows to guide the end 31*a* of the lead wire 31 to the binding terminal part 522 via this cutout part 45. Then, the existence of this cutout part 45 enables to create a state that the end 31*a* of the lead wire 31 does not contact the ring core 40. Here, the core members formed by hardening magnetic powder, including the drum core 20 in and the ring core 40, are normally inferior in dimensional accuracy of the radius of a corner portion (curving portion) compared to a resin molded product. Further, the core members are in a state of being hard and having a peculiar rough surface feeling compared to a resin molded product. Accordingly, when they are used for a long period in an environment where is vibrations are given, wire breakage easily occurs at a contact position in the end 31*a* with the core members.

However, in this embodiment, since it is possible to create a state that the end 31*a* of the lead wire 31 does not contact the ring core 40, it is possible to prevent breakage of the lead wire 31 at a contact portion of the ring core 40 and the end 31*a* even when the magnetic element 10 is used in an environment where vibrations are given. Since breakage of the lead wire 31 can be prevented effectively in an environment where vibrations are given, the number of windings of the coil 30 can be increased using a thin wire having a smaller diameter as the lead wire 31, and it is possible to increase the inductance value of the magnetic element 10.

Further, in this embodiment, the end 31*a* of the lead wire 31 forming the coil 30 is guided to the binding terminal part 522 while the end 31*a* is prevented from contacting the outer peripheral edge of the lower flange part 23 of the drum core 20. Accordingly, it is possible to further decrease the contact position of the end 31*a*, and the lead wire 31 can be prevented from breaking at the contact portion of the aforementioned outer peripheral edge and the end 31*a* even when the magnetic element 10 is used in an environment where vibrations are given. Since breakage of the lead wire 31 can thereby be prevented more effectively in an environment where vibrations are given, the number of windings of the coil 30 can be increased using a thin wire having a smaller diameter as the lead wire 31, and it is possible to increase the inductance value of the magnetic element 10.

Moreover, in this embodiment, the forming terminal part 523 is provided in the terminal member 52, this forming terminal part 523 is provided with the horizontal extending portion 523*b*, and this horizontal extending portion 523*b* is disposed to face the drum core 20 and the ring core 40. Thus, it is possible to effectively suppress movement of the drum core 20 and the ring core 40 toward the axial direction. Accordingly, breakage of the lead wire 31 can be prevented more effectively in an environment where vibrations are given, the number of windings of the coil 30 can be increased using a thin wire having a smaller diameter as the lead wire 31, and it is possible to increase the inductance value of the magnetic element 10.

Figure 14:
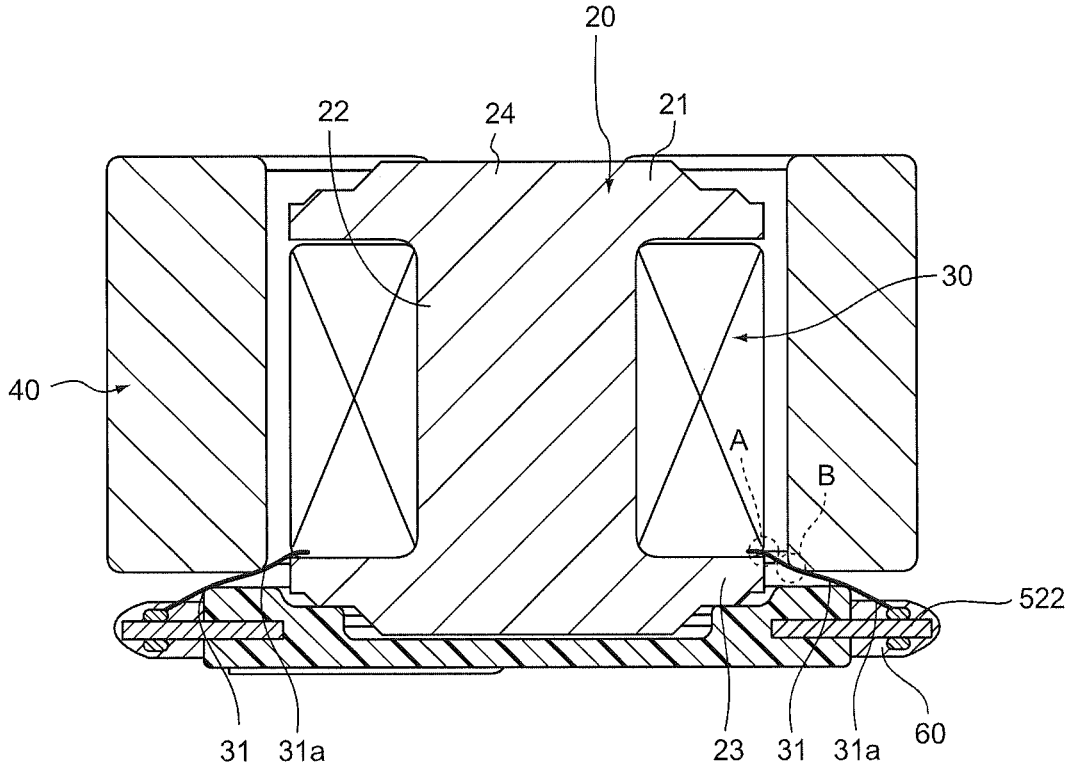
FIG. 14 is a cross-sectional side view illustrating a magnetic element as a comparative example of the magnetic element of FIG. 1.

Here, a magnetic element as a subject of comparison with the present invention is illustrated in FIG. 14. In the magnetic element illustrated in FIG. 14, the end 31*a* of the lead wire 31 forming the coil 30 contacts the outer peripheral edge of the lower flange part 23 (the portion circled by a dashed line A in FIG. 14 corresponds to this). Further, the end 31*a* of the lead wire 31 forming the coil 30 contacts an inner peripheral edge on a lower side of the ring core 40 (the portion circled by a dashed line B in FIG. 14 corresponds to this).

In such a structure illustrated in FIG. 14, since the end 31*a* contacts the core members in the portion circled by the dashed line A and the portion circled by the dashed line B, when it is used for a long period in an environment where vibrations are given, wire breakage easily occurs particularly in the portion circled by the dashed line A and the portion circled by the dashed line B. However, in this embodiment, portions where the end 31*a* contacts the core members, like the portion circled by the dashed line A and the portion circled by the dashed line B, do not exist as illustrated in FIG. 8, and only a portion where the end 31*a* contacts the guide portion 511 exists, which is a resin molded product. Accordingly, as described above, breakage of the end 31*a* (lead wire 31) can be prevented effectively, the number of windings of the coil 30 can further be increased using a thin wire having a small diameter, and it is possible to increase the inductance value of the magnetic element 10.

<Modification Examples>

In the foregoing, the magnetic element 10 according to one embodiment of the present invention has been described, but the present invention can be modified in various other ways. This will be described below.

In the above-described embodiment, the drum core 20 is used as a first core member. However, the first core member is not limited to the drum core 20. For example, the first core member may be formed of two core members, a T-shaped core and a disc-shaped core. Further, in the above-described embodiment, the case where the ring core 40 is used as a second core member is described. However, the second core member is not limited to the ring core 40. For example, the second core member may be formed by butting semi-annular core members. Further, as the second core member, a pot core having a bottom and a substantially U-shaped cross section may be used. When the pot core is used as the second core member, it is preferred that a T-shaped core be used as the first core member.

Further, in the above-described embodiment, the end portion 511A of the inner peripheral side of the guide portion 511 is provided at a higher height position than the upper face of the lower flange part 23. However, the end portion 511A may be provided lower than the upper face of the lower flange part 23. Also in this case, a contact portion of the end 31*a* and the ring core 40 like the portion circled by the dashed line B in FIG. 14 does not exist. Accordingly, as compared to the structure illustrated in FIG. 14, the possibility of breakage of the end 31*a* (lead wire 31) can be decreased.

Further, in the above-described embodiment, the upper flange part 21 and the lower flange part 23 of the drum core 20 are provided to have a substantially equal diameter. However, for example, the upper flange part may be formed larger in diameter than the lower flange part, or conversely, the upper flange part may be formed smaller in diameter than the lower flange part.

Further, in the above-described embodiment, the drum core 20 is provided to have a shape seen from above being a circular shape. However, the drum core and the ring core are not limited to the shape seen from above being a circular shape, and various shapes may be employed. Examples of the various shapes include polygons such as squares, hexagons, octagons and the like, and besides them, oval shapes, mixture of some straight line and some curve line and the like. Similarly, for the ring core 40, various shapes when seen from above may be employed, similarly to the aforementioned exemplification for the drum core 20. Further, in the above described embodiment, the columnar part 22 is provided to have a circular planar shape. However, the planar shape of the columnar part is not limited a circular shape. For example, the planar shape of the columnar part may be provided to have a polygonal shape, oval shape, and mixture of some straight line and some curve line.

Further, the magnetic element to which the present invention is applied may be an inductor or a transformer, and besides them, the present invention may be applied to a choke coil, a filter, or the like. That is, the present invention may be applied to various magnetic elements. Further, the magnetic element 10 in the above-described embodiment is most preferably applied to parts mounted in a vehicle, but it is not limited to such parts mounted in a vehicle but may be used for magnetic elements of various applications.

The magnetic element of the present invention can be used in the field of electric equipment.

What is claimed is:

1. A magnetic element, comprising:

a first core member having a pair of flange parts constituted of one flange part and another flange part, a columnar part coupling the pair of flange parts, and a winding frame part surrounded by the pair of flange parts and the columnar part;

a second core member disposed to face the first core member along an entire outer periphery thereof;

a coil disposed on the winding frame part by winding a lead wire; and a base shaped body on which the one flange part of the first core member is placed and on which the second core member is placed on an outer peripheral side with respect to the first core member, wherein the base shaped body is provided with a base member and a terminal member partially embedded in the base member, the terminal member is provided with a binding terminal part, which projects outward in a second corner part out of plural corner parts of the base member and projects from the base member on a side separated along an axial direction of the columnar part from a portion of the winding frame part side of the one flange part, and to which an end of the lead wire is bound, a user terminal part in a state integrated with the binding terminal part and the user terminal is electrically connected to an external mounting substrate, and a forming terminal part in a state integrated with both the binding terminal part and user terminal part, and the second core member is provided with a cutout part at a portion corresponding to the second corner part of the base member for allowing insertion of an end of the lead wire drawn out from the winding frame part in a state of not contacting the second core member;

further, the second core member is provided in a substantially rectangular shape and cut off parts are provided on at least two corners of the second core member forming the substantially rectangular shape which is cut off at an angle with respect to wall faces forming these corners, the forming terminal part is provided with a vertical extending portion and a horizontal extending portion continuing to the vertical extending portion, the vertical extending portion extends along an outer wall face of the second core member and along a first corner part out of plural corner parts, and the horizontal extending portion is bent from the vertical extending portion so as to be facing and contacting a face of the another flange part opposite to the winding frame part and a portion of the second core member opposite to the side placed on the base member.

2. The magnetic element according to claim 1, wherein the base member is provided with a guide portion guiding an end of the lead wire toward the binding terminal part on an outer peripheral side from the winding frame part on an inner peripheral side and having a taper shape descending from the inner peripheral side toward the outer peripheral side, and an inner peripheral end portion on the inner peripheral side of the guide portion is located on the other flange part side along the axial direction with respect to a portion on the winding frame part side of the one flange part.

3. The magnetic element according to claim 1, wherein an upper recessed portion recessed toward the side of the base member and on which the horizontal extending portion is located, is provided in a portion of the second core member opposite to the side placed on the base member.

* * * * *